US012092103B2

(12) United States Patent
Clements

(10) Patent No.: US 12,092,103 B2
(45) Date of Patent: Sep. 17, 2024

(54) FUEL PUMP WITH DETERMINANT TRANSLATING CAM ARRANGEMENT

(71) Applicant: Eaton Intelligent Power Limited, Dublin (IE)

(72) Inventor: Martin Augustine Clements, Loveland, OH (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/952,669

(22) Filed: Sep. 26, 2022

(65) Prior Publication Data

US 2023/0096852 A1 Mar. 30, 2023

Related U.S. Application Data

(60) Provisional application No. 63/248,184, filed on Sep. 24, 2021.

(51) Int. Cl.

| | |
|---|---|
| ***F04C 2/00*** | (2006.01) |
| ***F04C 2/332*** | (2006.01) |
| ***F04C 2/348*** | (2006.01) |
| ***F04C 14/22*** | (2006.01) |
| ***F04C 15/00*** | (2006.01) |
| ***F04C 15/06*** | (2006.01) |

(52) U.S. Cl.

CPC ..... *F04C 15/0065* (2013.01); *F04C 2/332* (2013.01); *F04C 2/348* (2013.01); *F04C 14/223* (2013.01); *F04C 14/226* (2013.01); *F04C 15/06* (2013.01); *F04C 2240/811* (2013.01)

(58) Field of Classification Search

CPC ..... F04C 2/332; F04C 2/344; F04C 2/348; F04C 14/223; F04C 14/226; F04C 15/0065

See application file for complete search history.

(56) References Cited

U.S. PATENT DOCUMENTS

| | | | | |
|---|---|---|---|---|
| 2,348,428 A * | 5/1944 | Tucker | F04C 14/223 418/31 |
| 2,589,449 A * | 3/1952 | Stageberg | F04C 14/223 418/31 |
| 2,782,724 A * | 2/1957 | Humphreys | F04C 14/223 418/133 |

(Continued)

FOREIGN PATENT DOCUMENTS

| | | |
|---|---|---|
| WO | 02/081921 A1 | 10/2002 |
| WO | 2004/009992 A1 | 1/2004 |

OTHER PUBLICATIONS

Extended European Search Report for Application No. 22197546.9 mailed Feb. 23, 2023.

*Primary Examiner* — Theresa Trieu

(74) *Attorney, Agent, or Firm* — Merchant & Gould P.C.

(57) ABSTRACT

A fuel pump includes a cam arrangement surrounding a rotor and disposed within a spacer ring. The cam arrangement is configured to deterministically translate relative to the spacer ring and the rotor during stroking of the pump. An involute gear set provides an interface between the cam arrangement and the spacer ring. In some cases, the involute gear set is configured to provide a linear translation of the cam arrangement along a timing line. In other cases, the involute gear set is configured to provide a linear translation of the cam arrangement at an angle relative to the timing line.

21 Claims, 7 Drawing Sheets

(56) References Cited

U.S. PATENT DOCUMENTS

| | | | | |
|---|---|---|---|---|
| 7,108,493 | B2 | 9/2006 | Clements et al. | |
| 7,491,043 | B2 | 2/2009 | Clements et al. | |
| 8,740,593 | B2 | 6/2014 | Clements et al. | |
| 2006/0099100 | A1* | 5/2006 | Clements | F04C 2/3442 418/173 |
| 2006/0171834 | A1* | 8/2006 | Ogata | F04C 2/102 418/171 |
| 2009/0129960 | A1 | 5/2009 | Yamamuro et al. | |
| 2011/0150682 | A1* | 6/2011 | Nyzen | F04C 14/24 418/26 |

* cited by examiner

FUEL PUMP WITH DETERMINANT TRANSLATING CAM ARRANGEMENT

CROSS-REFERENCE TO RELATED APPLICATIONS

This application claims the benefit of U.S. Provisional Patent Application No. 63/248,184, filed Sep. 24, 2021. The disclosure of the priority application in its entirety is hereby incorporated by reference into the presence application.

BACKGROUND

Referring to FIG. 8, a positive displacement pump 10 provides a constant fluid flow at a fixed speed regardless of changes is fluid pressure. A pump housing 12 includes a stator or housing having an inlet port and an outlet port. A rotor 20 is disposed within a pump chamber 14 within the housing 12. In certain examples, the inlet and outlet ports are diametrically offset relative to an axis of rotation 30 of the rotor 20.

Multiple vanes 26 may be circumferentially spaced around and may radially extend outwardly from the rotor 20. Such vane pumps 10 use one or more stationary, or non-rotating, cam rings 50. Outer radial tips of the vanes 26 slide along the cam rings 50. The cam rings 50 are not, however, free to rotate relative to the housing 12. In some cases, the stationary cam rings 50 are rigidly fixed to a pump housing 12 in a fixed displacement pump 10. In other cases, the cam ring 50 moves or pivots relative to the pump housing 12 to provide variable displacement capability. A rotor axis 30 is parallel to, but offset from a longitudinal axis of the cam ring 50. The offset relationship of the axes causes the vanes 26 to move radially inward and outward relative to the rotor 20 during rotation.

The spacer ring 40 has a flat or planar cam rolling surface 42 and receives an anti-rotation pin 44. The pin 44 pivotally receives the cam sleeve 50 that is non-rotatably received around the rotor 20. Selective actuation results in rolling movement of the cam sleeve 50 along a generally planar or flat surface 66 located along an inner surface of the spacer ring 40 adjacent on the pin 44. The pin 44 limits the distance the cam sleeve 50 can slide relative to the spacer ring 40, but does not eliminate slipping-especially during movement of the cam sleeve 50 towards a full stroke of the pump 10. The slipping results in an uncommanded change in pump displacement, which limits the ability of a pump controller to determine the pump displacement at any given time.

SUMMARY

Aspects of the disclosure are directed to a fuel pump having a determinant translating cam ring and methods of use thereof.

In accordance with some aspects of the disclosure, a cam arrangement interfaces with a spacer ring at an involute gear set that prevents slippage therebetween. Accordingly, the displacement position of the pump can be determined at any given time based on the position of the corresponding actuator assemblies.

In certain implementations, the involute gear set includes a rack and pinion gear set. In certain implementations, the involute gear set includes an involute tooth and corresponding notch. In certain implementations, the involute gear set includes a first part formed by the cam arrangement and having a finite pitch diameter and a second part formed by the spacer ring and having an infinite pitch diameter.

In some implementations, the translation axis of the cam arrangement is coaxial with or parallel to a timing line extending between the inlet and outlet ports of the pump. In other implementations, the translation axis of the cam arrangement is angled relative to the timing axis to compensate for deformation of the cam arrangement during stroking of the pump.

In other implementations, an involute gear set includes a first part formed by the cam arrangement and having a finite pitch diameter and a second part formed by the spacer ring and having a finite pitch diameter that is sufficiently large to provide substantially linearly translation of the first part over the second part while also allowing compensation motion to accommodate deformation of the cam arrangement during stroking of the pump.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Reference will now be made in detail to exemplary aspects of the present disclosure that are illustrated in the accompanying drawings. Wherever possible, the same reference numbers will be used throughout the drawings to refer to the same or like parts.

Figure 1:
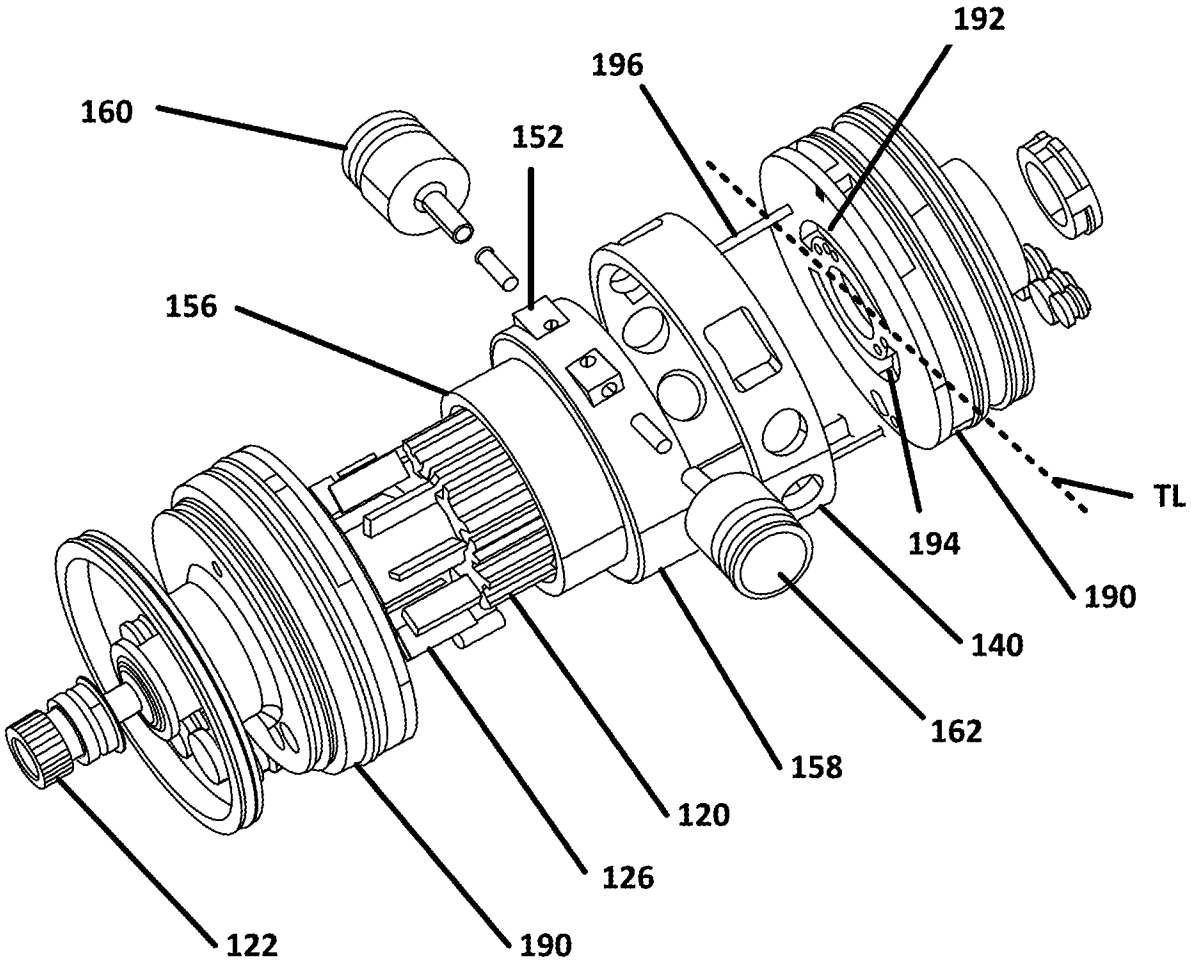
FIG. 1 is a perspective view of an example fuel pump assembly shown with the components exploded from each other for ease in viewing.
Figure 8:
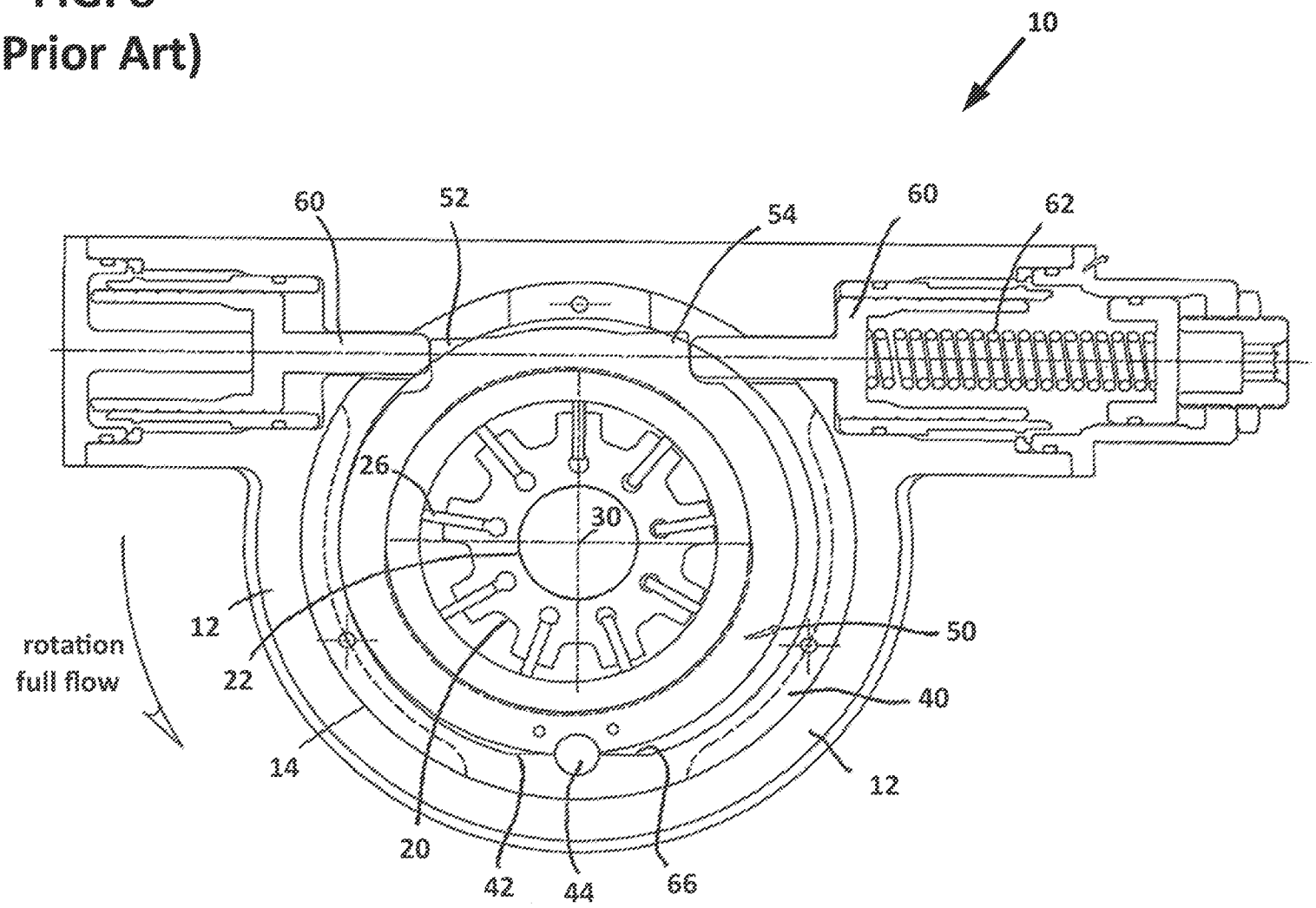
FIG. 8 (Prior Art)
FIG. 8 shows a transverse cross-section of a prior art fuel pump.

Referring to the figures in general, a pump assembly 100 includes a housing 102 having a pump chamber 104 defined therein. Rotatably received in the chamber 104 is a rotor 120 secured to a journal shaft 122 for rotating the rotor 120 within the chamber 104 about a rotation axis R. A cam arrangement 150 is disposed around the rotor 120. A spacer ring 140 is radially disposed between the cam arrangement 150 and the housing 102. During a stroke, the cam arrangement 150 is configured to roll relative to the spacer ring 140 between a zero displacement position and a full displacement position (e.g., see FIG. 2). The spacer ring 140 is fixed relative to the housing 102 and a port plate 190 (e.g., using alignment pegs 196 inserted through apertures 180). First and second lobes or actuating surfaces 152 are provided on the cam arrangement 150 (e.g., see FIG. 1). For another example, see also lobes 52, 54 of FIG. 8. The lobes 152 are not visible in FIG. 2, but are located behind the spacer 140. The lobes 152 cooperate with first and second actuator assemblies 160, 162 to alter the position of the cam arrangement 150 relative to the rotor 120 along a stroke between the zero and full displacement positions. In certain implementations, the actuator assemblies 160, 162 may push against the lobes 152 to roll the cam arrangement 150 relative to the spacer ring 140. For example, each actuator assembly 160, 162 may include a spring-biased piston (e.g., see piston 60 biased by spring 62 in FIG. 8) that pushes against the respective lobe 152. Selective actuation of the actuator assemblies 160, 162 results in rolling movement of the cam arrangement 150 between the zero and full displacement positions.

Figure 2:
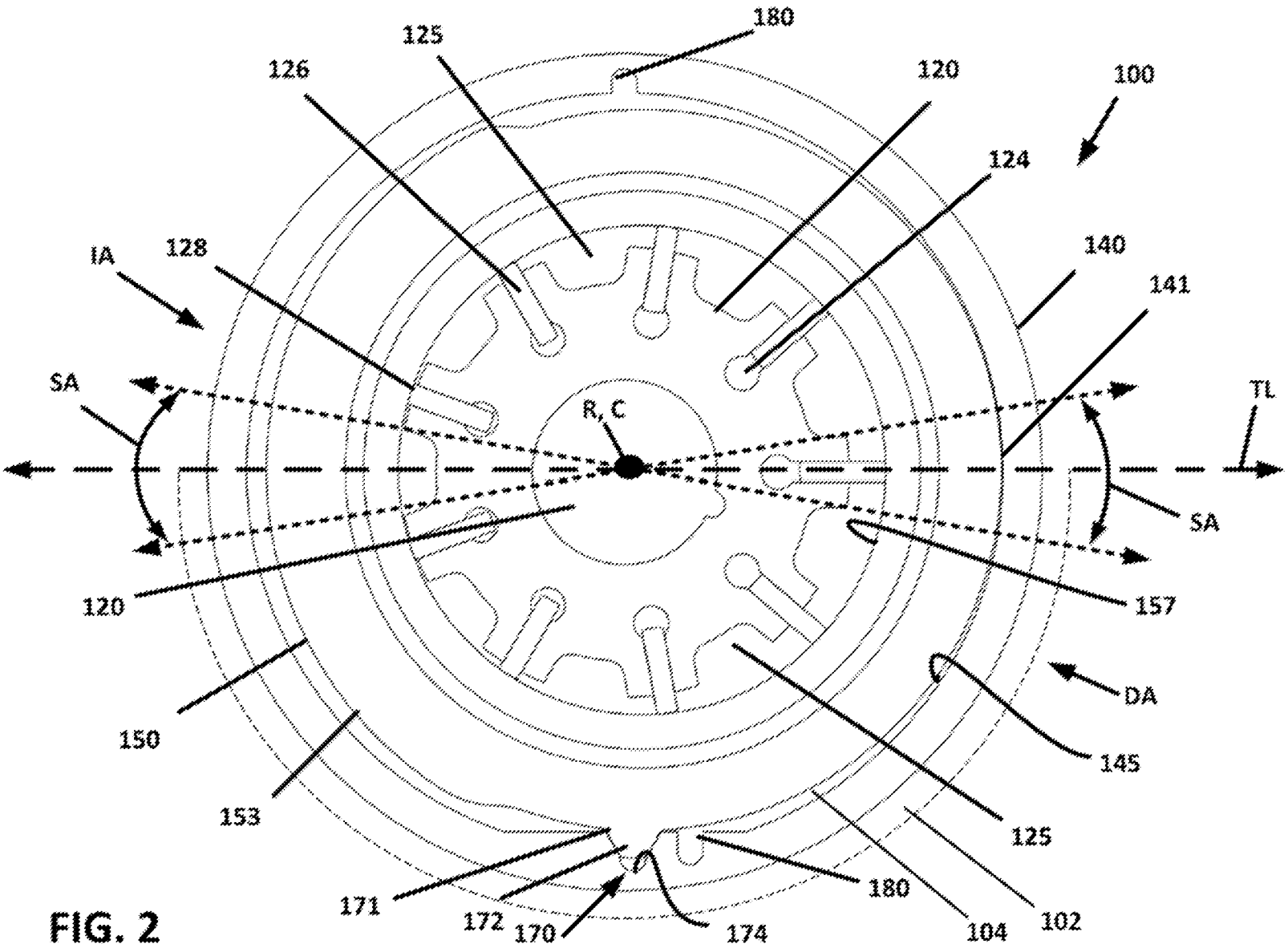
FIG. 2 is a schematic diagram of a transverse cross-section taken of the fuel pump assembly of FIG. 1 so that a spatial relationship between a rotor, a cam arrangement, and a spacer ring is shown.

Referring to FIG. 2, the rotor 120 defines a series of grooves 124 peripherally or circumferentially spaced from each other and extending radially inward towards the rotation axis R. The grooves 124 may vary in number. For example, nine (9) grooves 124 are shown in the embodiment of FIG. 2. In other examples, however, a different number of grooves 124 can be used without departing from the scope and intent of the present invention. Each groove 124 is configured to receive a blade or vane 126. Each vane 126 extends outwardly from the groove 124 so that an outer radial tip 128 engages an inner surface 157 of the cam arrangement 150. Pumping chambers 125 are defined between each of the vanes 126 as the vanes 126 rotate in the pump chamber 104 with the rotor 120 and provide positive displacement of the fluid. The vanes 126 are slidable within the grooves 124 along axes extending radially outwardly from the rotor 120.

In a variable displacement vane pump, the cam arrangement 150 moves eccentric to the rotor 120 to achieve a pumping displacement of the vanes 126. Inlet ports 192 and outlet ports 194 are defined in the port plate 190 and aligned with the pumping chambers 125. In particular, the inlet ports 192 are aligned with pumping chambers 125 disposed at one side of a timing line TL (i.e., along the inlet arc IA) and outlet ports 194 are aligned with pumping chambers 125 disposed at the opposite side of the timing line TL (i.e., along the discharge arc DA). The inlet arc IA and discharge arc DA are separated by seal arcs SA that separate the inlet and outlet ports 192, 194. In certain examples, the timing line TL extends through the seal arcs SA. The cam arrangement 150 is configured relative to the rotor 120 so that the pumping chambers 125 expand when located along the inlet arc IA and contract when located along the discharge arc DA.

Accordingly, low pressure fluid enters the pumping chambers 125 through the inlet ports 192 as the pumping chambers 125 are expanding and high pressure fluid is discharged through the outlet ports 194 as the pumping chambers 125 are contracting. Exposing a pumping chamber 125 to an inlet port 192 while the pumping chamber 125 is contracting may result in pulsation, pressure trapping, and even potential breakage of the pump 100. Exposing a pumping chamber 125 to an outlet port 194 while expanding may result in pressure drops and cavitation. Accordingly, the cam arrangement 150 is configured relative to the port plate 190 to properly align the ports 192, 194.

In certain implementations, the cam arrangement 150 translates along a translation axis TA during a pump stroke to achieve the eccentric position of the cam arrangement 150 relative to the rotor 120. In particular, the cam arrangement 150 interfaces with the spacer ring 140 so that a center point M of the cam arrangement 150 moves along the translation axis T as the cam arrangement 150 is rolled relative to the spacer ring 140. When in the zero displacement position, the center point M of the cam arrangement 150 is coaxial with the rotation axis R of the rotor 120 (e.g., see FIG. 2). In certain examples, the translation axis TA is coaxial with the timing line TL. When in the full displacement position, the center point M of the cam arrangement 150 is parallel to, but offset along the translation axis T from the rotation axis R (e.g., see FIG. 3). In certain examples, the translation axis TA is coaxial with the timing line TL. In certain examples, the translation axis TA is parallel to the timing line TL. Maintaining the center point M of the cam arrangement 150 along the timing line TL (or at a fixed offset from the timing line TL) maintains the position of the pumping chambers 125 relative to the ports 192, 194, which maintains the timing of the fluid inlet and discharge.

In certain implementations, relative motion between the cam arrangement 150 and the spacer ring 140 is limited by an involute gear set 170. The involute gear set 170 includes a first part having a finite pitch diameter and a second part having an infinite pitch diameter (e.g., a rack and pinion gear set). In certain implementations, the first part is formed by the cam arrangement 150 and the second part is formed by the spacer ring 140. In some implementations, the cam arrangement 150 defines an involute tooth 172 and the spacer ring 140 defines a straight-sided notch 174 sized to receive the involute tooth 172. In other implementations, the cam arrangement 150 defines the notch portion 174 of the gear set 170 and the spacer ring 140 defines the tooth portion 172 of the gear set 170. In certain examples, the first part is formed at a location 171 at an outer periphery of the cam arrangement 150.

Figure 4:
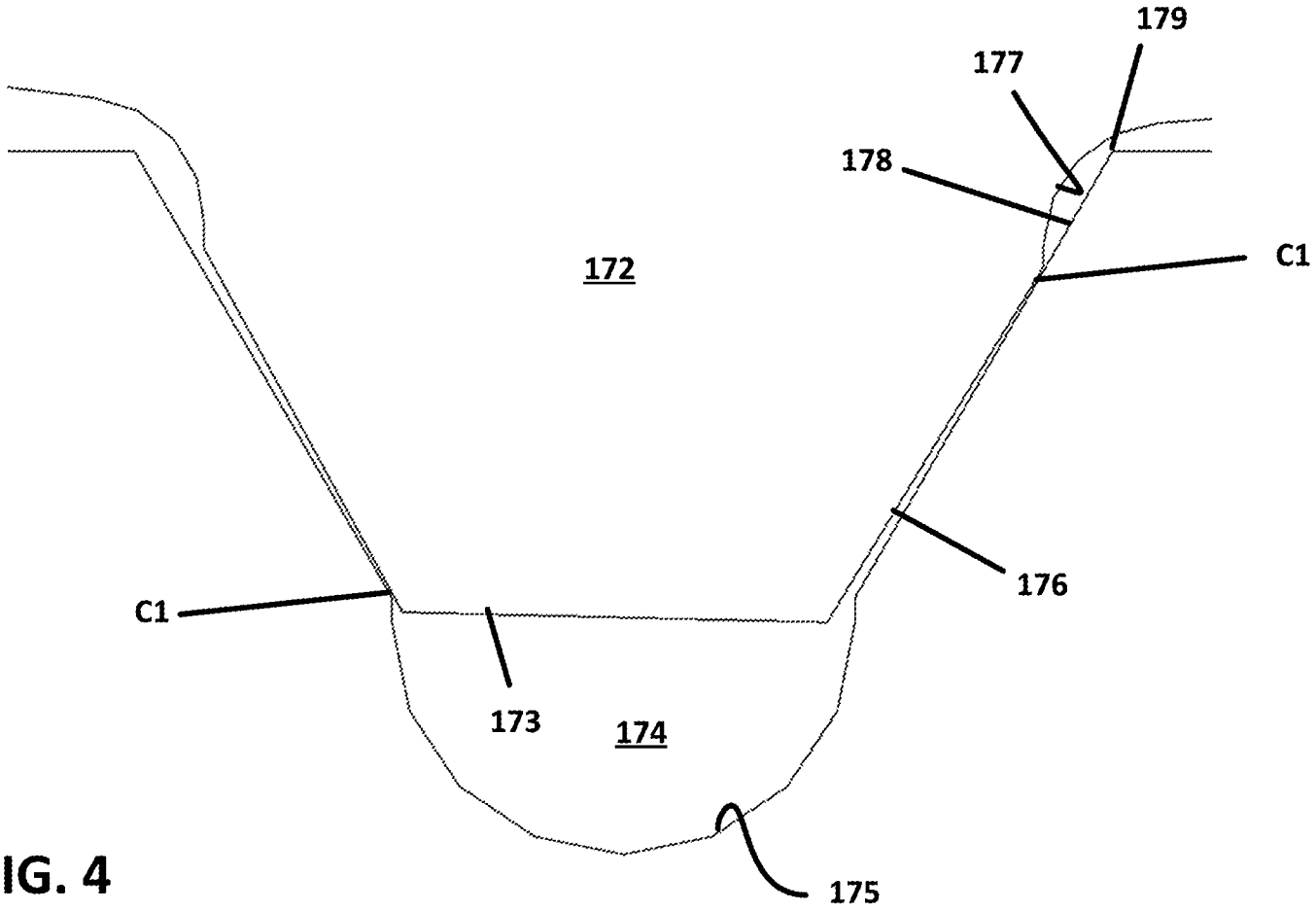
FIG. 4 is an enlarged view of a portion of FIG. 2.

An example tooth 172 and notch 174 are shown in FIG. 4. The tooth 172 has peripheral sides 176 having a finite involute curve. The notch 174 has linear walls 178 (i.e., having an infinite pitch diameter). The curve of the peripheral sides 176 provides only a single point of contact Cl with each side of the notch wall 178 and each side of the tooth 172. In certain implementations, the notch 174 defines a well 175 or cavity that extends away from a tip 173 (e.g., a flat topped tip) of the tooth 172. In certain implementations, undercuts 177 at either side of the tooth 172 prevents contact with corners 179 of the notch walls 178. These cavities 175 and undercuts 177 help to ensure that the sides 176 of the involute tooth 172 contact the walls 178 of the notch 174 at only the respective single instantaneous points. Such engagement prevents slipping of the tooth 172 relative to the notch 174 and, hence, prevents slipping of the cam arrangement 150 relative to the spacer ring 140. Accordingly, the movement of the cam arrangement 150 relative to the spacer ring 140 is based solely on the movement applied by the actuator assemblies 160, 162.

Figure 3:
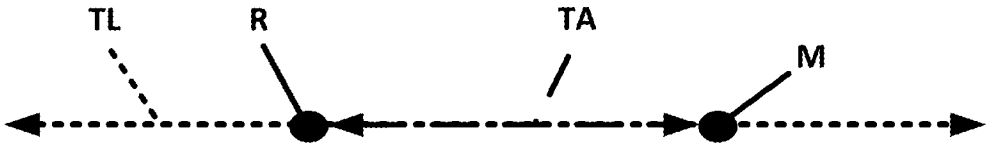
FIG. 3 is a schematic diagram showing the translation axis for the center point of the cam arrangement of FIG. 2 based on the interaction of an involute gear set.

Referring to FIG. 3, in certain implementations, the interface between the involute tooth 172 and the notch 174 allows the cam arrangement 150 to roll relative to the spacer ring 140 while maintaining a position of the center point M along the timing line TL (or at a fixed offset relative to the timing line TL) without requiring a flat inner surface of the spacer ring 140. While such a flat surface is shown in FIG. 2, such a surface is not required. In fact, in certain examples, the regions of the cam arrangement 150 surrounding the tooth 172 or notch 174 do not engage the spacer ring 140. Rather, the cam arrangement 150 contacts the spacer ring 140 at the involute gear set 170 and at one point of contact 141 spaced along a circumference of the cam arrangement 150 from the involute gear set 170. In some examples, the inner surface 145 of the spacer ring 140 may be continuously contoured excepting the involute gear set 170 and apertures 180 for alignment pegs. In other examples, the inner surface 145 may have a flat surface at or near where the tooth 172 or notch 174 is defined.

In certain implementations, the cam arrangement 150 may be configured to inhibit deformation of the cam arrangement 150 during high pressure situations (e.g., during a full stroke of the pump 100). In certain examples, the cam arrangement 150 includes a portion 154 that extends radially outward from a portion of the outer circumference to provide additional stiffness to the cam arrangement 150. For example, the portion 154 may extend over a region that would otherwise deform when subjected to the stress of a full or nearly full pump stroke.

Figure 5:
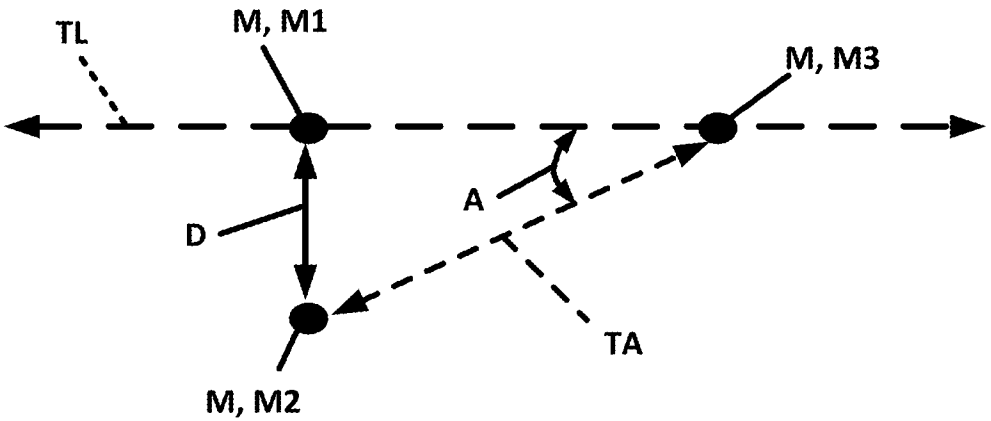
FIG. 5 is a schematic diagram showing the translation axis for the center point of the cam arrangement of FIG. 2 when the involute gear set is configured to accommodate deformation of the cam arrangement.

Referring to FIG. 5, the cam arrangement 150 may still be deformed by high pressures (e.g., when the cam arrangement 150 is disposed at or near the full displacement position). Deformation of the cam arrangement 150 shifts the center point M of the cam arrangement 150 relative to the timing line TL from a first position M1 to a second position M2 by a deformation distance D (e.g., 0.005 inches, 0.0001 inches, 0.00015 inches, 0.0002 inches, etc.). Accordingly, in certain examples, deformation causes the center point M to shift from aligning with the timing line TL to being offset from the timing line TL, which may interfere with timing the input and discharge of fluid to the expansion and contraction of the pumping chambers 125. In certain examples, if the center point M is normally at a fixed offset from the timing line TL, then deformation may increase the offset.

To compensate for this deformation, the interface (e.g., the involute gear set 170) between the cam arrangement 150 and the spacer ring 140 may be configured to shift the center point M of the cam arrangement 150 relative to the spacer ring 140 (and hence relative to the port plate 190) to realign the center point M with the timing line TL at or near the full displacement position of the cam arrangement 150. In certain implementations, the translation axis TA along which the center point M of the cam arrangement 150 shifts is not coaxial or parallel with the timing line TL. Rather, the translation axis TA may be angled relative to the timing line TL.

In certain implementations, the interface between the cam arrangement 150 and the spacer ring 140 is configured to roll the cam arrangement 150 up or down the angle A as the cam arrangement 150 is moved between the zero displacement position and the full displacement position. In certain examples, the slope of the flat walls 178 of a notch 174 may be configured to provide rolling movement of the cam arrangement 150 along the angle A. In certain examples, the slope of the flat walls 176 of a tooth 172 may be configured to provide rolling movement of the cam arrangement 150 along the angle A (when the notch has the involute walls with the finite pitch diameter).

In other implementations, the cam arrangement 150 can be positioned relative to the spacer ring 140 so that the center point M is located offset from the timing line TL when the cam arrangement 150 is not deformed (e.g., when the system is under low pressure). The position may be determined so that the center point M of the cam arrangement 150 shifts to aligning with the timing line TL when the cam arrangement 150 deforms (e.g., under high system pressure). For example, the degree of deformation expected during a full stroke (i.e., when the cam arrangement 150 is moved to the full displacement position) can be calculated and the distance over which the center point M is expected to move can be determined. The cam arrangement 150 can be positioned relative to the spacer ring 140 (and hence the port plate 190) so that the center point M is offset from (e.g., above) the timing line TL by the distance so that the center point M will be positioned at the timing line TL (e.g., will drop towards the timing line TL) when deformed during translation of the cam arrangement 150.

Figure 7:
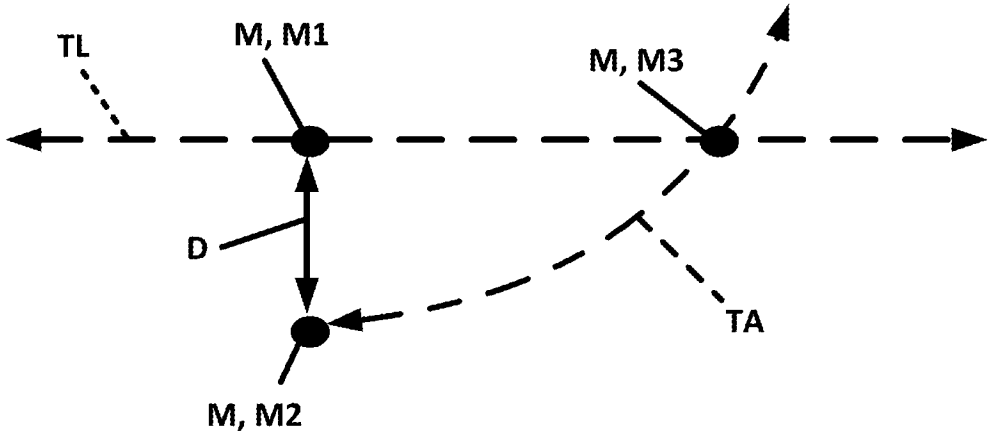
FIG. 7 is a schematic diagram showing the translation path for the center point of the cam arrangement of FIG. 2 when the involute gear set is configured with two finite pitch diameters to accommodate deformation of the cam arrangement.

Referring to FIG. 7, in other implementations, an involute gear set 170 includes a first part 172 formed by the cam arrangement 150 and having a finite pitch diameter and a second part 174 formed by the spacer ring 140 and having a finite pitch diameter. A second part 174 having a sufficiently large finite pitch diameter may provide near linear translation with just enough non-linear movement to compensate for deformation of the cam arrangement 150 during a pump stroke. For example, the finite pitch diameter of the second part 174 may be selected to provide motion following a sufficiently gradual curve to move a midpoint M of the cam arrangement 150 a compensation distance (e.g., 0.005 inches, 0.0001 inches, 0.00015 inches, 0.0002 inches, etc.) against a direction of deformation while also moving the midpoint along the timing line TL a distance of a full pump stroke.

Figure 6:
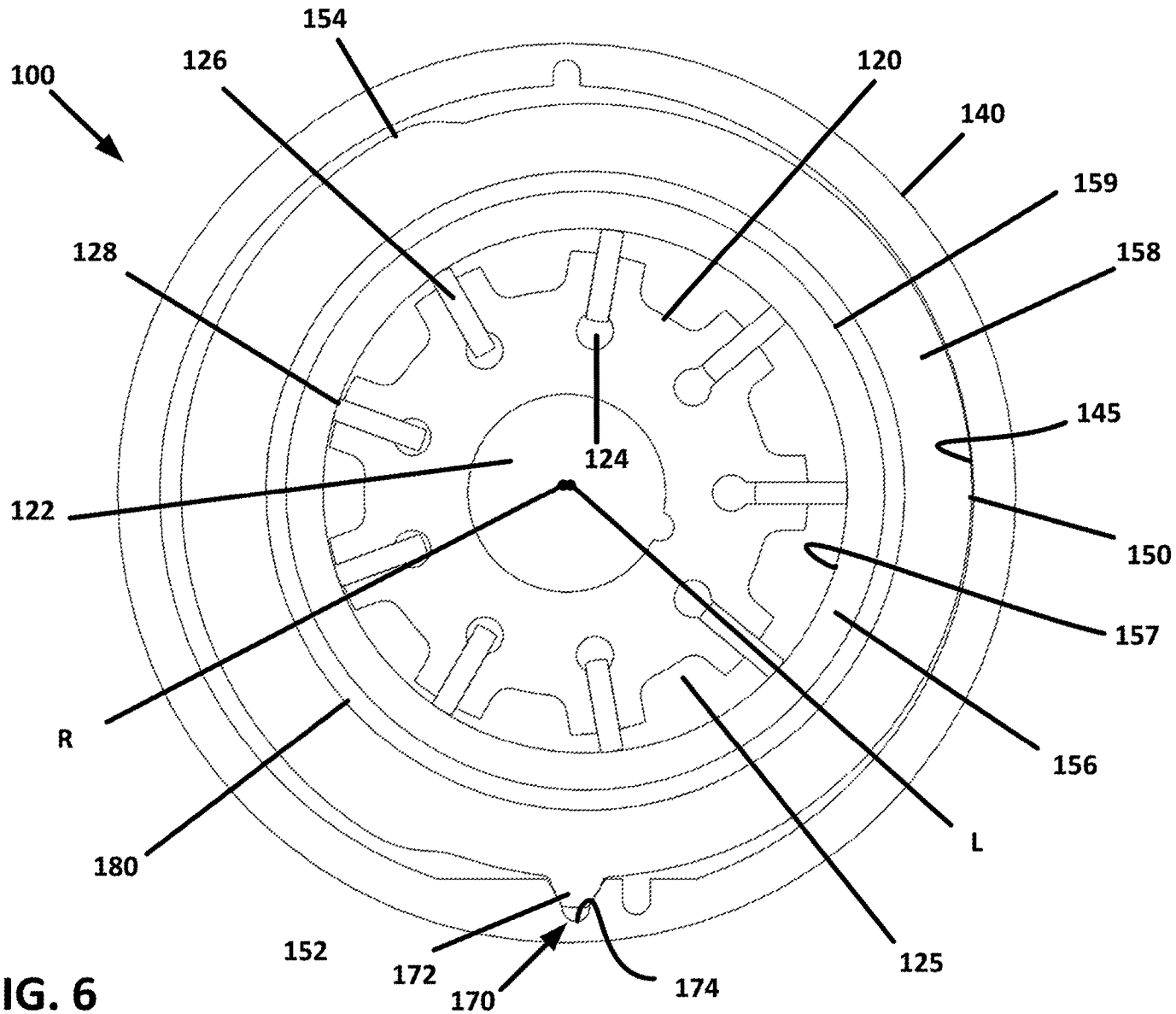
FIG. 6 is a schematic diagram of a transverse cross-section taken of the fuel pump assembly of FIG. 1.

In some implementations, the cam arrangement 150 is monolithically formed. In other implementations, the cam arrangement 150 is unitarily formed from different materials. For example, an inner portion of the cam arrangement 150 may be formed from Tungsten carbide while an outer portion may be formed from steel. In other implementations, the cam arrangement 150 may be formed from multiple components (e.g., see FIG. 6). For example, the cam arrangement 150 may include a cam ring 156 disposed within an outer sleeve 158. The cam ring 156 defines a smooth, inner peripheral wall 157 that is contacted by the outer tips 128 of the individual vanes 126 extending from the rotor 120. An outer, smooth peripheral wall 159 of the cam ring 156 is configured for free rotation within the cam sleeve 158.

In certain implementations, a journal bearing 180 supports the rotating cam ring 156 within the sleeve 158. The journal bearing 180 is filled with the pump fluid, e.g., jet fuel, and defines a hydrostatic or hydrodynamic, or a hybrid hydrostatic/hydrodynamic bearing. In certain implementations, the journal bearing 180 forms a continuous passage. That is, there is no interconnecting structural component such as roller bearings, pins, or the like between the cam ring 156 and the journal bearing 180. In certain examples, the cam ring 156 is free to rotate relative to the rotor 120 because there is no structural component interlocking the cam ring 156 for rotation with the rotor 120.

Aspects of the Disclosure

Aspect 1. A fuel pump comprising:

a housing having a pump chamber, an inlet in fluid communication with the pump chamber, and an outlet in fluid communication with the pump chamber;

a spacer ring fixedly mounted to the housing;

a rotor disposed in the pump chamber;

a cam arrangement radially interposed between the rotor and the spacer ring, the cam arrangement engaging the spacer ring at an interface at which the cam arrangement rolls relative to the spacer ring between a zero displacement position and a full displacement position;

an involute gear set defining the interface between the cam arrangement and the spacer ring, the involute gear set including a first part formed by the cam arrangement and a second part formed by the spacer ring; and an actuator configured to roll the cam arrangement relative to the spacer ring to selectively vary pump output while maintaining a center point of the cam arrangement along a linear translation axis.

Aspect 2. The fuel pump of aspect 1, wherein the first part has a finite pitch diameter and the second part has an infinite pitch diameter Aspect 3. The fuel pump of aspect 1 or aspect 2, wherein the first part includes a tooth and the second part includes a notch.

Aspect 4. The fuel pump of aspect 1 or aspect 2, wherein the first part includes a notch and the second part includes a tooth.

Aspect 5. The fuel pump of any of aspects 1-4, further comprising a port plate fixedly coupled to the spacer ring, the port plate defining a plurality of inlet ports and outlet ports disposed at opposite sides of a timing line.

Aspect 6. The fuel pump of aspect 5, wherein the linear translation axis is coaxial with the timing line.

Aspect 7. The fuel pump of aspect 5, wherein the linear translation axis is parallel to the timing line.

Aspect 8. The fuel pump of aspect 5, wherein the linear translation axis is angled relative to the timing line.

Aspect 9. The fuel pump of any of aspects 1-8, wherein the center point of the cam arrangement is coaxial with a rotation axis of the rotor when the cam arrangement is disposed in the zero displacement position.

Aspect 10. The fuel pump of any of aspects 1-8, wherein the center point of the cam arrangement is offset from, but parallel to a rotation axis of the rotor when the cam arrangement is disposed in the zero displacement position.

Aspect 11. The fuel pump of any of aspects 1-10, wherein the cam arrangement includes a cam ring disposed within a cam sleeve, the cam ring being formed of a different material than the cam sleeve.

Aspect 12. The fuel pump of aspect 11, wherein the cam ring is movable relative to the cam sleeve.

Aspect 13. The fuel pump of any of aspects 1-12, further comprising circumferentially spaced vanes operatively associated with the rotor, the vanes extending from grooves defined in the rotor to an inner surface of the cam arrangement to define a plurality of pumping chambers in alignment with the inlet and outlet ports of the port plate.

Aspect 14. A fuel pump comprising:

a housing arrangement defining a pump chamber, the housing arrangement including a port plate defining a plurality if inlet ports and a plurality of outlet ports disposed at opposite sides of a timing line;

a spacer ring fixedly mounted to the port plate;

a rotor disposed in the pump chamber and configured to rotate relative to the spacer ring, the rotor including a plurality of outwardly extending vanes;

a cam arrangement radially interposed between the rotor and the spacer ring, the cam arrangement engaging the spacer ring at an interface at which the cam arrangement rolls relative to the spacer ring between a zero displacement position and a full displacement position, the cam arrangement cooperating with the vanes to define pumping chambers, the cam arrangement having a center point that moves along a translation axis as the cam arrangement moves between the zero displacement position and the full displacement position, and the interface being configured so that the translation axis is angled relative to the timing line; and an actuator configured to roll the cam arrangement relative to the spacer ring to selectively vary pump output.

Aspect 15. The fuel pump of aspect 14, wherein the cam arrangement is mounted to the spacer ring so that the center point is offset from the timing line when the cam arrangement is disposed in the zero displacement position.

Aspect 16. The fuel pump of aspect 14, wherein the cam arrangement is mounted to the spacer ring so that the center point is coaxial with the timing line when the cam arrangement is disposed in the zero displacement position.

Aspect 17. The fuel pump of any of aspects 14-16, wherein the cam arrangement is mounted to the spacer ring so that the center point is aligned with the timing line when the cam arrangement is disposed in the full displacement position.

Aspect 18. The fuel pump of any of aspects 14-17, wherein the interface includes an involute gear arrangement.

Aspect 19. The fuel pump of aspect 18, wherein the involute gear arrangement includes an involute tooth carried by the cam arrangement and a notch defined by the spacer ring.

Aspect 20. The fuel pump of aspect 18, wherein the involute gear arrangement includes a first part carried by the cam arrangement having a finite pitch diameter and a second part carried by the spacer ring having an infinite pitch diameter.

Aspect 21. A fuel pump comprising:

a housing having a pump chamber, an inlet in fluid communication with the pump chamber, and an outlet in fluid communication with the pump chamber;

a spacer ring fixedly mounted to the housing;

a rotor disposed in the pump chamber;

a cam arrangement radially interposed between the rotor and the spacer ring, the cam arrangement engaging the spacer ring at an interface at which the cam arrangement rolls relative to the spacer ring between a zero displacement position and a full displacement position;

an involute gear set defining the interface between the cam arrangement and the spacer ring, the involute gear set including a first part formed by the cam arrangement and a second part formed by the spacer ring; and an actuator configured to move the cam arrangement relative to the spacer ring to selectively vary pump output during a pump stroke.

Aspect 22. The fuel pump of aspect 21, wherein the first part having a finite pitch diameter and the second part having a finite pitch diameter.

Aspect 23. The fuel pump of aspect 21, wherein the first part having a finite pitch diameter and the second part having an infinite pitch diameter.

Aspect 24. The fuel pump of aspect 21, wherein the cam arrangement is configured to deform so that a centerpoint of the cam arrangement is moved along a deformation direction by a deformation distance during the pump stroke; and the involute gear set is configured to provide a compensation motion of the centerpoint of the cam arrangement counter to the deformation direction.

Having described the preferred aspects and implementations of the present disclosure, modifications and equivalents of the disclosed concepts may readily occur to one skilled in the art. However, it is intended that such modifications and equivalents be included within the scope of the claims which are appended hereto.

What is claimed is:

1. A fuel pump comprising:

a housing having a pump chamber, an inlet in fluid communication with the pump chamber, and an outlet in fluid communication with the pump chamber;

a spacer ring fixedly mounted to the housing;

a rotor disposed in the pump chamber;

a cam arrangement radially interposed between the rotor and the spacer ring, the cam arrangement engaging the spacer ring at an interface at which the cam arrangement rolls relative to the spacer ring between a zero displacement position and a full displacement position;

an involute gear set defining the interface between the cam arrangement and the spacer ring, the involute gear set including a first part formed by the cam arrangement and a second part formed by the spacer ring; and an actuator configured to roll the cam arrangement relative to the spacer ring to selectively vary pump output while maintaining a center point of the cam arrangement along a linear translation axis;

wherein one of the first and second parts includes an involute tooth and the other of the first and second parts includes a notch sized to receive the involute tooth, and the involute tooth has peripheral sides each having an involute curve.

2. The fuel pump of claim 1, wherein the notch has linear walls.

3. The fuel pump of claim 1, wherein the notch includes a well, the tooth includes a truncated tip, and the tip is configured not to extend into the well; and wherein the tooth includes an undercut at at least one of the peripheral sides, the notch includes a corner on a linear notch wall, and the undercut is configured to accommodate the corner.

4. The fuel pump of claim 1, further comprising a port plate fixedly coupled to the spacer ring, the port plate defining a plurality of inlet ports and outlet ports disposed at opposite sides of a timing line.

5. The fuel pump of claim 4, wherein the linear translation axis is coaxial with the timing line.

6. The fuel pump of claim 4, wherein the linear translation axis is parallel to the timing line.

7. The fuel pump of claim 4, wherein the linear translation axis is angled relative to the timing line.

8. The fuel pump of claim 1, wherein the center point of the cam arrangement is coaxial with a rotation axis of the rotor when the cam arrangement is disposed in the zero displacement position.

9. The fuel pump of claim 1, wherein the center point of the cam arrangement is offset from, but parallel to a rotation axis of the rotor when the cam arrangement is disposed in the zero displacement position.

10. The fuel pump of claim 1, wherein the cam arrangement includes a cam ring disposed within a cam sleeve, the cam ring being formed of a different material than the cam sleeve.

11. The fuel pump of claim 10, wherein the cam ring is movable relative to the cam sleeve.

12. The fuel pump of claim 1, further comprising circumferentially spaced vanes operatively associated with the rotor, the vanes extending from grooves defined in the rotor to an inner surface of the cam arrangement to define a plurality of pumping chambers in alignment with the inlet and outlet ports of a port plate.

13. The fuel pump of claim 1, further comprising first and second lobes, wherein the first and second lobes are provided on the cam arrangement at a location opposite the involute gear set, and wherein the actuator is configured to push against the first and second lobes to roll the cam arrangement relative to the spacer ring.

14. A fuel pump comprising:

a housing arrangement defining a pump chamber, the housing arrangement including a port plate defining a plurality of inlet ports and a plurality of outlet ports disposed at opposite sides of a timing line;

a spacer ring fixedly mounted to the port plate;

a rotor disposed in the pump chamber and configured to rotate relative to the spacer ring, the rotor including a plurality of outwardly extending vanes;

a cam arrangement radially interposed between the rotor and the spacer ring, the cam arrangement engaging the spacer ring at an interface at which the cam arrangement rolls relative to the spacer ring between a zero displacement position and a full displacement position, the cam arrangement cooperating with the vanes to define pumping chambers, the cam arrangement having a center point that moves along a translation axis as the cam arrangement moves between the zero displacement position and the full displacement position, and the interface being configured so that the translation axis is angled relative to the timing line;

an actuator configured to roll the cam arrangement relative to the spacer ring to selectively vary pump output; and an involute gear set defining the interface between the cam arrangement and the spacer ring, the involute gear set including a first part formed by the cam arrangement and a second part formed by the spacer ring;

wherein one of the first and second parts includes an involute tooth and the other of the first and second parts includes a notch sized to receive the involute tooth, and the involute tooth has peripheral sides each having an involute curve.

15. The fuel pump of claim 14, wherein the cam arrangement is mounted to the spacer ring so that the center point is offset from the timing line when the cam arrangement is disposed in the zero displacement position.

16. The fuel pump of claim 14, wherein the cam arrangement is mounted to the spacer ring so that the center point is coaxial with the timing line when the cam arrangement is disposed in the zero displacement position.

17. The fuel pump of claim 14, wherein the cam arrangement is mounted to the spacer ring so that the center point is aligned with the timing line when the cam arrangement is disposed in the full displacement position.

18. The fuel pump of claim 14, wherein the interface includes an involute gear arrangement.

19. A fuel pump comprising:

a housing having a pump chamber, an inlet in fluid communication with the pump chamber, and an outlet in fluid communication with the pump chamber;

a spacer ring fixedly mounted to the housing;

a rotor disposed in the pump chamber;

a cam arrangement radially interposed between the rotor and the spacer ring, the cam arrangement engaging the spacer ring at an interface at which the cam arrangement rolls relative to the spacer ring between a zero displacement position and a full displacement position;

an involute gear set defining the interface between the cam arrangement and the spacer ring, the involute gear set including a first part formed by the cam arrangement and a second part formed by the spacer ring;

an actuator configured to move the cam arrangement relative to the spacer ring to selectively vary pump output during a pump stroke; and wherein one of the first and second parts includes an involute tooth and the other of the first and second parts includes a notch sized to receive the involute tooth, and the involute tooth has peripheral sides each having an involute curve.

20. The fuel pump of claim 19, wherein the cam arrangement is configured to deform so that a center point of the cam arrangement is moved along a deformation direction by a deformation distance during the pump stroke; and the involute gear set is configured to provide a compensation motion of the center point of the cam arrangement counter to the deformation direction.

21. A fuel pump comprising:

a housing having a pump chamber, an inlet in fluid communication with the pump chamber, and an outlet in fluid communication with the pump chamber;

a spacer ring fixedly mounted to the housing;

a rotor disposed in the pump chamber;

a cam arrangement radially interposed between the rotor and the spacer ring, the cam arrangement engaging the spacer ring at an interface at which the cam arrangement rolls relative to the spacer ring between a zero displacement position and a full displacement position;

an involute gear set defining the interface between the cam arrangement and the spacer ring, the involute gear set including a first part formed by the cam arrangement and a second part formed by the spacer ring;

an actuator configured to roll the cam arrangement relative to the spacer ring to selectively vary pump output while maintaining a center point of the cam arrangement along a linear translation axis;

wherein the first part includes a tooth and the second part includes a notch, or wherein the first part includes a notch and the second part includes a tooth, and wherein the tooth includes peripheral sides;

wherein the notch includes a well, the tooth includes a truncated tip, and the tip is configured not to extend into the well; and wherein the tooth includes an undercut at at least one of the peripheral sides, the notch includes a corner on a linear notch wall, and the undercut is configured to accommodate the corner.

* * * * *